US005924416A

United States Patent [19]

Miller

[11] Patent Number: 5,924,416

[45] Date of Patent: Jul. 20, 1999

[54] UNDERWATER BREATHING APPARATUS

[76] Inventor: Harry R. Miller, 4938 Frontenac Rd., Trumansburg, N.Y. 14886

[21] Appl. No.: 09/192,834

[22] Filed: Nov. 16, 1998

[51] Int. Cl.[6] ..... B63C 11/02

[52] U.S. Cl. ..... 128/201.27; 128/202.14

[58] Field of Search ..... 128/201.27, 201.28, 128/202.14; 114/315; 441/91; 405/185, 186

[56] References Cited

U.S. PATENT DOCUMENTS

| | | | |
|---|---|---|---|
| 813,431 | 2/1906 | Iwanami et al. | 128/201.27 |
| 1,331,819 | 2/1920 | Matheny | 405/186 |
| 3,400,680 | 9/1968 | Taylor | 114/16 |
| 3,470,822 | 10/1969 | Evans et al. | 103/35 |
| 4,390,305 | 6/1983 | Sloan | 405/186 |
| 4,472,082 | 9/1984 | Kröling | 405/186 |
| 4,674,493 | 6/1987 | Mitchell | 128/202.14 |
| 5,082,464 | 1/1992 | Clink | 114/315 |
| 5,193,530 | 3/1993 | Gamow et al. | 128/201.27 |
| 5,327,849 | 7/1994 | Miller | 114/315 |
| 5,471,976 | 12/1995 | Smith | 128/201.27 |

*Primary Examiner*—Aaron J. Lewis
*Attorney, Agent, or Firm*—Brown, Pinnisi & Michaels, P.C.

[57] ABSTRACT

A floating apparatus for providing breathable pressurized air to a submerged swimmer(s). A inflatable tube supports a combination of two containers at the waters surface. The top container is a sealed battery compartment and mating cover which holds a battery for powering the compressor(s) and a means for mounting said compressor(s) in a position that allows for submersion at the waters surface. The top container is also used as shield and water deflector to prevent the intake of water into the compressors. The outlets of the compressors are joined and adapted to one or more hoses to provide air to a submerged swimmer(s). The bottom container is a cover which protects the electrically powered compressor(s) and provides a means to allow water entry to cool said compressor(s).

10 Claims, 2 Drawing Sheets

UNDERWATER BREATHING APPARATUS

FIELD OF THE INVENTION

The invention pertains to the field of apparatus for pumping breathing air to a submerged diver. More particularly, the invention pertains to electric floating compressors for supplying breathing air to divers.

BACKGROUND OF THE INVENTION

Many types of apparatus have been designed to allow a swimmer to breathe underwater.

The simplest, a snorkel, is simply a tube which extends from the swimmer's mouth to the surface. The disadvantage of the snorkel is that a swimmer would have to hold his breath to go any deeper than the surface of the water.

Another method for a diver to breathe underwater is to have a pump located on the water's surface on a boat or separate float. Air is then supplied through a hose and regulator or may simply be fed into a pressurized suit worn by such diver, as has been used for many years for deep sea diving.

Another apparatus is a pressurized tank of air, which a diver wears on his back to supply air through a hose and regulator in the diver's mouth. This is the "Self Contained Underwater Breathing Apparatus" or SCUBA, which was popularized by Jacques Cousteau in the early 1950's. The diver can breathe at depths below the surface with tank pressure sufficient to compensate for water pressure at a particular depth. However, there is a need for extensive training for such a device.

Another apparatus has been designed to float independently on the surface of the water and pump air to a submerged swimmer. Typically such a device consists of an air compressor and a gasoline engine attached to a float tube. However, the gasoline engine is heavy and requires combustible fuel, and there are risks of contamination of the diver's air supply from the exhaust of the gasoline engine.

Electrically powered compressors are cleaner but they produce an electrical arc at the armature of their motor. This arc is potentially dangerous, and gases (including hydrogen) emitted by the battery can cause safety problems.

Traditionally, diving devices use electric motors and compressors that are open to the environment and are cooled by ambient air, which causes excessive heat buildup, reduces battery life, and requires continual maintenance due to environmental exposure. There is a need for a small, floating, electrically powered diving device that uses a sealed motor and compressors that are water cooled to increase efficiency, protect electrical components, and supply breathing air to a diver.

The following U.S. patents are representative of the prior art:

Taylor's "Catamaran for Underwater Exploration", U.S. Pat. No. 3,400,680, is a floating air compressor and propulsion unit. Typical of the prior art, the compressor is located above the floatation unit, hence above the water level.

Evans' "Floating Pump", U.S. Pat. No. 3,470,822, uses a gasoline-powered engine on a float, driving a semi-submerged pump. Unlike the present invention, however, the pump is a centrifugal water pump with an inlet below the water level, used for pumping water for fire fighting purposes. The dangers and disadvantages of using a gasoline engine are discussed above, although the concern of air-supply contamination is not relevant in Evans' water-pumping.

Mitchell's "Underwater Breathing Apparatus", U.S. Pat. No. 4,674,493, is a floating compressor for providing air to a swimmer. The motor and pump are contained in a sealed floating container, which prevents contact between the compressor and the water.

The present inventor's 1994 US patent, "Underwater Breathing Apparatus", U.S. Pat. No. 5,327,849, is a floating electrical compressor, in which a floatation device supports a combination of two containers above the surface of the water. The top container, in the form of an inverted box, holds one or more electrically powered compressors. The bottom container holds a battery for powering the compressors. The compressors are in the upper compartment, above the waterline, and thus are not water-cooled.

SUMMARY OF THE INVENTION

The present invention is a floating apparatus for providing pressurized air to a submerged swimmer. An inflatable floatation tube supports a combination of two containers at the water's surface. The bottom container protects and covers one or more electrically powered compressors that are submersed in the water. The intakes of the compressors are placed high enough to prevent unwanted water from entering the intakes of the compressors by means of a cover that shields them. The hoses to provide air to a submerged swimmer(s) are connected to the outlet(s) of the compressor (s). The top container holds a battery for powering the compressors. This container has a sealed cover that provides a means to keep potentially dangerous gases away from the intakes of the compressors.

The use of electrically powered compressor(s) eliminates the risk of fumes caused by gasoline driven compressors. The use of a sealed battery compartment and submerged electrical compressors eliminates the potential intake or explosion of harmful gases from battery chemical reactions.

The submersion of the electric compressors assures cooling and electrical efficiency for maximum battery life. In addition, the submerged compressors supply cooled air preventing the problem of over heat in the air supply line.

The use of multiple compressors also has the built in safety factor in the case of mechanical failure in one compressor.

The top and bottom containers are fastened together with the battery above and the compressor below the water surface. This arrangement gives a center of gravity below the center of the tube allowing the apparatus to float with stability on the water's surface. The unit is easily disassembled to top, bottom and float tube for carrying and storage.

DESCRIPTION OF THE PREFERRED EMBODIMENT

Figure 1:
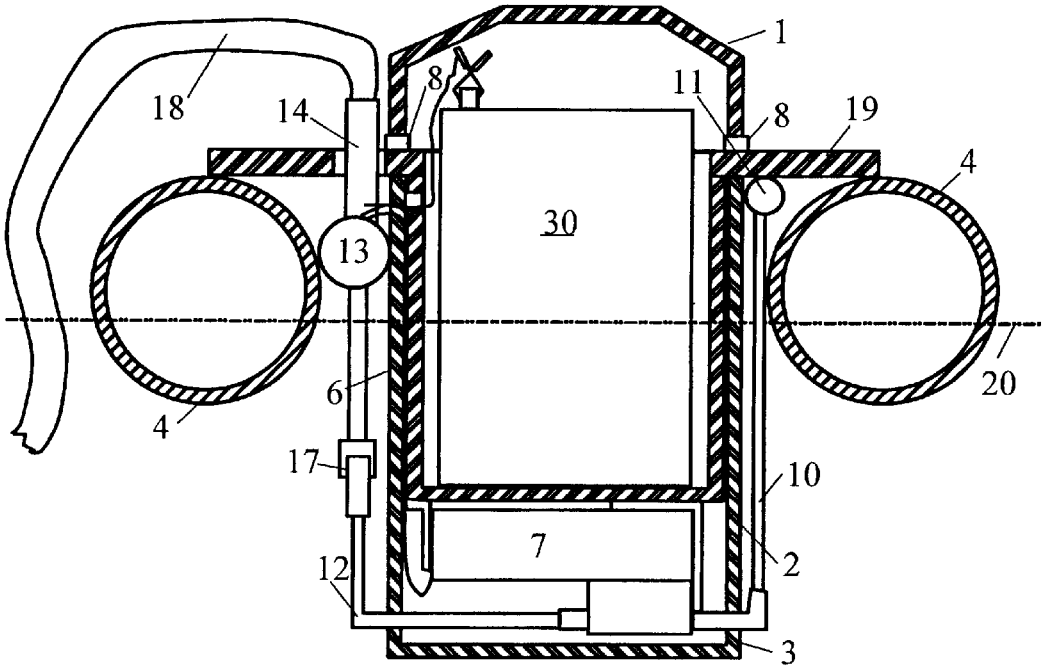
FIG. 1 shows a side cut-away view of the invention.
Figure 3:
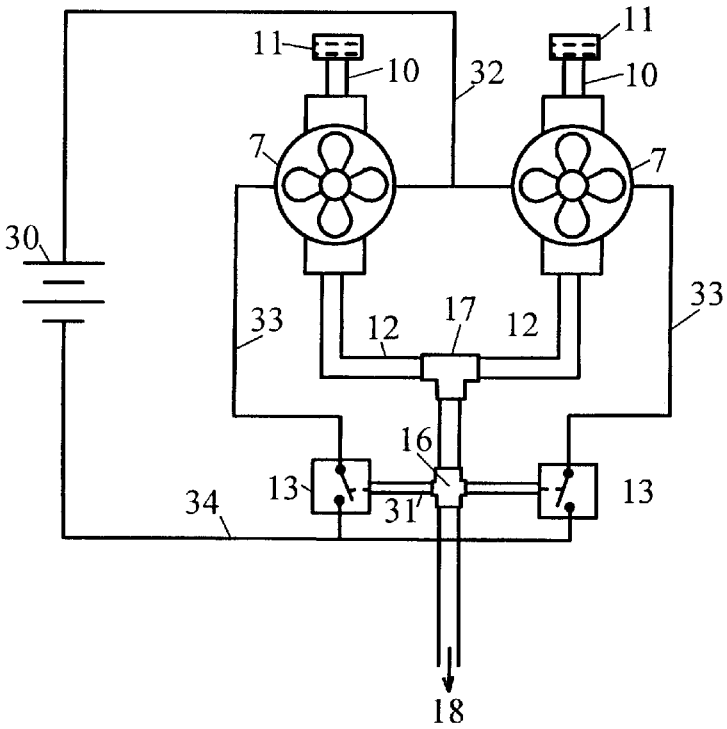
FIG. 3 shows a schematic view of the invention.
Figure 2:
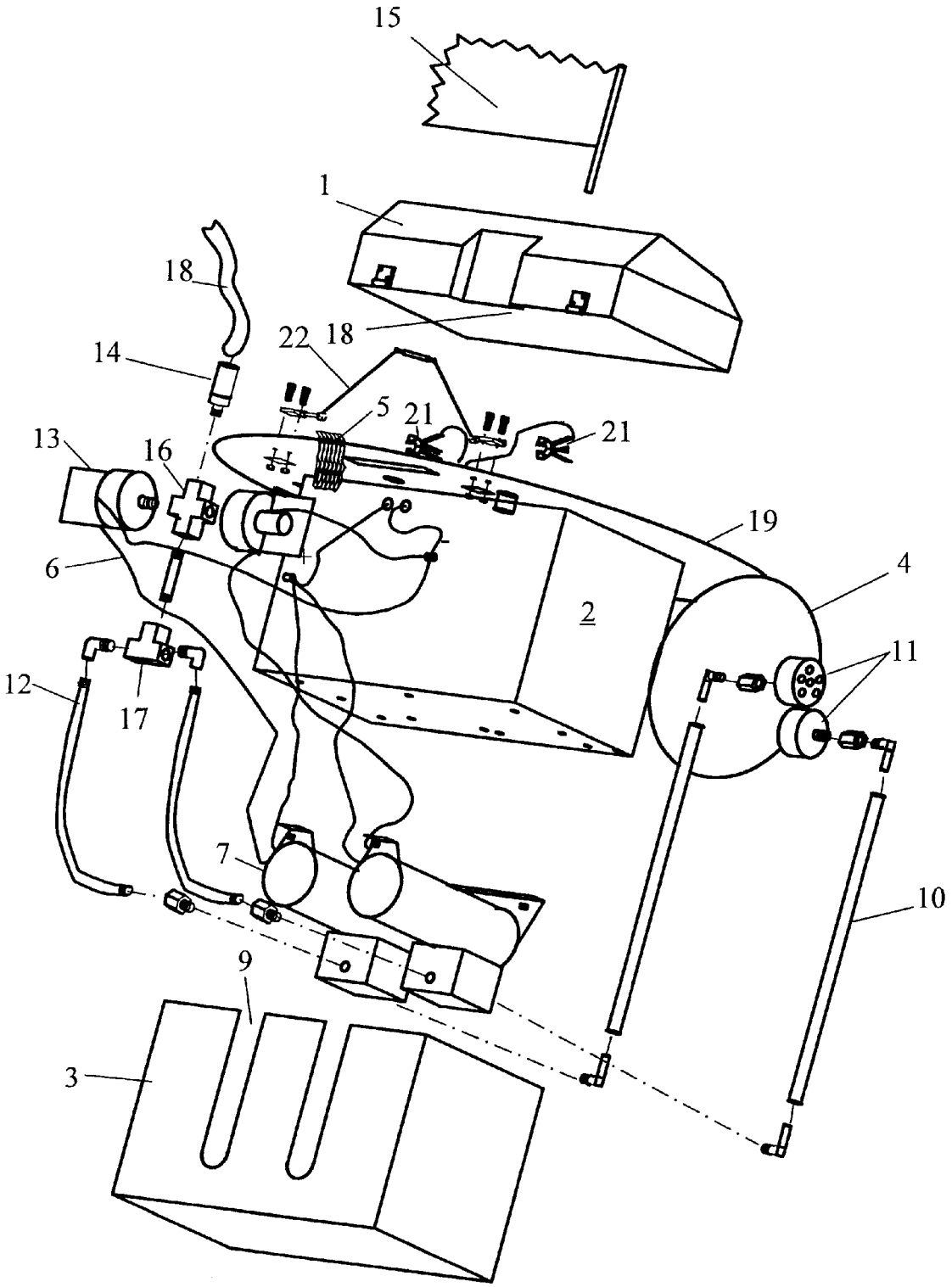
FIG. 2 shows an exploded view of the invention.

FIG. 1 shows the underwater breathing device of the invention, in a side cut-away view, and FIG. 2 shows an exploded view of the components of the invention. FIG. 3 shows a simplified schematic of the air and electrical components of the invention. The following discussion applies to all three figures, with identical reference numbers being used in each.

A floatation support (4) supports a combination of two containers (2) and (3) at the waters surface (20). Preferably, the floatation support is an inflatable tube, such as a tire inner tube. However, the floatation support might also be made of closed-cell foam material such as Styrofoam® multicellular expanded synthetic resinous material or the like, as is commonly used for life rings, or other floating synthetic materials. The floatation support could also be in the form of a rigid hollow body made of metal or plastic.

The bottom container (3) protects and covers one or more electrically powered compressors (7). The lower container has slots (9) which allow water to enter the container (3), submerging the compressors (7). The use of electrically powered compressor(s) eliminates the risk of fumes caused by gasoline driven compressors. The submersion of the electric compressors assures cooling and electrical efficiency for maximum battery life. In addition, the submerged compressors supply cooled air preventing the problem of overheat in the air supply line.

If desired, a single compressor would provide enough air for one diver. However, the use of multiple compressors also has the built in safety factor in the case of mechanical failure in one compressor. A pair of 315 Series Wob-L® Piston compressors, manufactured by Thomas Compressors and Vacuum Pumps of Sheboygan, Wis., have been found to be useful in this application. These pumps operate on 12 volts DC, and are capable of being submerged as required by the invention. The model 315CDC45/12, for example, can supply 0.70 CFM of air at 60 PSI, with a current draw of 18 A or less.

The air inlets of the compressors (7) are connected to air intakes (11), placed high enough on support pipes (10) to prevent unwanted water from entering the intakes, and underneath the supporting cover (19) that shields them and serves to support the assembly upon the floatation tube (4). Although the preferred embodiment of the invention, shown in the drawings, has separate air intakes for each compressor so that a blockage could not cut off the entire air supply, if desired, the air inlets of the compressors (7) could be combined into a common manifold leading from a single air intake.

The output of each compressor (7) is connected through a hose (12) to a "T" fitting (17), which combines the outputs. The combined output is then routed to the hose (18) which provides air to a submerged swimmer, connected through fitting (14).

Preferably, a four-way fitting (16) is provided in the air system to permit one or more pressure switches (13) to sense the pressure in the air outlet.

A Guardian P/V™ pressure switch, manufactured by Whitman Controls Corporation Bristol, Conn., has been found to be useful for this application. The switch is selected to turn on (close) when the pressure drops below a preselected value. For this application, a setting of 50 psi has been found to be useful, although other pressures could be used.

Preferably, each compressor has its own air switch, for redundancy. If desired, one of the switches could be chosen to have a higher cut-out pressure than the other, so that the compressors would cut in sequentially rather than simultaneously, providing a demand function which runs one compressor as long as it keeps the pressure up, and cuts in a second compressor as needed. Alternatively, a single pressure switch could be used to control all compressors, or the outputs of the multiple pressure switches could be paralleled so that a failure of one switch would not result in an unusable compressor. Although not preferred, the pressure switch(es) could be omitted, and the compressors run continuously with a demand mouthpiece for the diver.

FIG. 3 shows the electrical schematic of this arrangement. Wire (32) from the battery (30) is connected to both compressors (7). The other wire from each compressor (7) is preferably connected to a pressure switch (31) by wire (33), such that each pressure switch (13) controls a single compressor (7). The two pressure switches (13) are then connected to the battery (30) by wire (33).

The top container (2) holds a battery (30) for powering the compressors (7). This container has a cover (1) with a seal (8) that provides a means to keep potentially dangerous gases away from the intakes (11) of the compressors (7). The use of a sealed battery compartment and submerged electrical compressors eliminates the potential intake or explosion of harmful gases from battery chemical reactions.

The top (2) and bottom containers (3) are fastened together underneath the support shield (19), with the battery (30) above and the compressors (7) below the water surface (20). This arrangement gives a center of gravity below the center of the flotation tube (4), allowing the apparatus to float with stability on the water's surface (20).

The unit is easily disassembled to top, bottom and float tube for carrying and storage, once assembled, is mounted to the float tube (4) by securing straps (5).

A diver's flag (15) may be attached to the lid (1), as shown.

Accordingly, it is to be understood that the embodiments of the invention herein described are merely illustrative of the application of the principles of the invention. Reference herein to details of the illustrated embodiments are not intended to limit the scope of the claims, which themselves recite those features regarded as essential to the invention.

What is claimed is:

1. An air supply apparatus for providing pressurized air to a submerged swimmer, capable of floating upon the surface of a body of water, comprising:

a) a floatation support;

b) an upper container mounted upon the floatation support;

c) a lower container mounted upon the floatation support, at least partially below the surface of the water when the apparatus is floating upon the water;

d) at least one electrically powered air compressor, located within the lower container, at least partially submerged when the apparatus is floating upon the water, having an electrical input, an air inlet and an air output, such that when electric power is supplied to the electrical input, air is taken from the air inlet and supplied under pressure at the air output;

e) an air intake located above the surface of the water when the apparatus is floating upon the water, connected to the air inlet of the air compressor;

f) air line fitting means for attaching an air hose for supplying air to a diver, connected to the air output of the air compressor;

g) a battery located in the upper container, electrically coupled to the electrical input of the air compressor.

2. The apparatus of claim 1, in which the upper container is sealed, such that harmful gases are prevented from entering the air intake system.

3. The apparatus of claim 1, in which the electrically powered air compressor is sealed, such that hydrogen gas produced by the battery is prevented from causing an explosion due to the arc of a running electric motor.

4. The apparatus of claim 1, further comprising a support shield, supported by the floatation support and forming a support for the upper container and lower container, the shield covering the air intake, such that the intake is protected from water intake.

5. The apparatus of claim 1, further comprising a pressure switch in the electrical coupling between the battery and the electrical input of the air compressor, having a sensing input connected to the air output of the air compressor, such that the electrical input of the air compressor is connected to the battery when the air pressure in the air outlet drops below a preselected value.

6. The apparatus of claim 1, in which there are a plurality of air compressors, each with an electrical input, an air inlet and an air output, and the air outputs of the air compressors are connected together.

7. The apparatus of claim 6, in which each of the air inlets of the air compressors is connected to a separate air intake.

8. The apparatus of claim 6, in which the air inlets from the plurality of air compressors are connected to a common air intake.

9. The apparatus of claim 6, further comprising at least one pressure switch in the electrical coupling between the battery and the electrical input of at least one of the plurality of air compressors, having a sensing input connected to the air output of at least one of the air compressors, such that the electrical input of the air compressor is connected to the battery when the air pressure in the air outlet drops below a preselected value.

10. The apparatus of claim 9, in which there is a pressure switch for each air compressor.

* * * * *